US011282421B2

(12) United States Patent
Yang et al.

(10) Patent No.: US 11,282,421 B2
(45) Date of Patent: Mar. 22, 2022

(54) METHOD OF DETECTING A PIXEL DEFECT

(71) Applicant: SAMSUNG DISPLAY CO., LTD., Yongin-Si (KR)

(72) Inventors: Gunwoo Yang, Seoul (KR); Yongbin Kim, Hwaseong-Si (KR); Hyun Young Choi, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/818,348

(22) Filed: Mar. 13, 2020

(65) Prior Publication Data

US 2020/0402432 A1 Dec. 24, 2020

(30) Foreign Application Priority Data

Jun. 19, 2019 (KR) ..... 10-2019-0073108

(51) Int. Cl.
*G09G 3/00* (2006.01)
*G09G 3/3241* (2016.01)
*G09G 3/3266* (2016.01)

(52) U.S. Cl.
CPC ..... *G09G 3/006* (2013.01); *G09G 3/3241* (2013.01); *G09G 3/3266* (2013.01)

(58) Field of Classification Search
CPC ..... G09G 3/006; G09G 3/3241; G09G 3/3266
See application file for complete search history.

(56) References Cited

U.S. PATENT DOCUMENTS

2009/0109142 A1* 4/2009 Takahara ..... G09G 3/006 345/76
2014/0362130 A1* 12/2014 Duan ..... G09G 3/3225 345/690
2016/0027382 A1* 1/2016 Chaji ..... G09G 3/3233 345/212
2017/0032722 A1* 2/2017 Wang ..... G09G 3/006

FOREIGN PATENT DOCUMENTS

KR 10-2018-0126116 11/2018
KR 10-2018-0128548 12/2018

* cited by examiner

*Primary Examiner* — Alexander Eisen
*Assistant Examiner* — Kebede T Teshome
(74) *Attorney, Agent, or Firm* — F. Chau & Associates, LLC

(57) ABSTRACT

A method of detecting a pixel defect for detecting a defect of a pixel including first to fourth transistors, connected to a data line, and receiving a scan signal and an initialization control signal includes turning on the first through fourth transistors by changing the scan signal and the initialization control signal to have a turn-on voltage level in an inspection period, detecting an inspecting current flowing in a path corresponding to the first through fourth transistors using a current detector that is connected to the data line, determining that a threshold voltage of the second transistor is within a normal range when the inspecting current is within a reference range, and determining that the threshold voltage of the second transistor is out of the normal range when the inspecting current is out of the reference range.

21 Claims, 5 Drawing Sheets

METHOD OF DETECTING A PIXEL DEFECT

CROSS-REFERENCE TO RELATED APPLICATION

This application claims priority under 35 U.S.C. § 119 to Korean Patent Application No. 10-2019-0073108, filed on Jun. 19, 2019 in the Korean Intellectual Property Office (KIPO), the disclosure of which is incorporated by reference herein in its entirety.

TECHNICAL FIELD

Embodiments relate generally to a display device. More particularly, embodiments relate to a method of detecting a pixel defect for detecting a defect of a pixel included in a display device in a manufacturing process of the display device before shipment of the display device.

DISCUSSION OF RELATED ART

Generally, a defective product (e.g., a defective display device) may be prevented from being provided to consumers by detecting a defect of a pixel included in the display device in a manufacturing process of the display device before shipment of the display device. Particularly, because there is a limit in compensating for threshold voltage deviation among driving transistors of pixels included in the display device (e.g., by performing a threshold voltage compensating operation on the pixels) when the threshold voltage deviation is severe, it may be important to sort out defective products that include pixels in which a threshold voltage of the driving transistor is out of a normal range before shipment.

A conventional method detects the pixel in which the threshold voltage of the driving transistor is out of the normal range by measuring the threshold voltage of the driving transistor of the pixel by measuring a time during which a storage capacitor of the pixel is charged. For example, the time during which the storage capacitor of the pixel is charged is relatively short when the threshold voltage of the driving transistor of the pixel is relatively small and the time during which the storage capacitor of the pixel is charged is relatively long when the threshold voltage of the driving transistor of the pixel is relatively large. Additionally, a current flowing through the driving transistor of the pixel due to a discharge of the storage capacitor may be measured.

However, the conventional method has a limit in accurately detecting whether the threshold voltage of the driving transistor of the pixel is out of the normal range because capacitance of the storage capacitor of the pixel is smaller than that of a parasitic capacitor existing in a data line and the like connected to the pixel, and because the current flowing through the driving transistor due to the discharge of the storage capacitor is very small (e.g., a few nano-amperes (nA) of current).

SUMMARY

According to an embodiment, a method of detecting a pixel defect for detecting a defect of a pixel that includes a first transistor including a gate terminal configured to receive a scan signal, a first terminal connected to a data line, and a second terminal connected to a first node, a second transistor including a gate terminal connected to a second node, a first terminal connected to the first node, and a second terminal connected to a third node, a third transistor including a gate terminal configured to receive the scan signal, a first terminal connected to the third node, and a second terminal connected to the second node, a fourth transistor including a gate terminal configured to receive an initialization control signal, a first terminal connected to the second node, and a second terminal configured to receive an initialization voltage, and a storage capacitor including a first terminal configured to receive a first power voltage and a second terminal connected to the second node may include turning on the first through fourth transistors by changing the scan signal and the initialization control signal to have a turn-on voltage level in an inspection period, detecting an inspecting current flowing in a path corresponding to the first through fourth transistors using a current detector that is connected to the data line, determining that a threshold voltage of the second transistor is within a normal range when the inspecting current is within a reference range, and determining that the threshold voltage of the second transistor is out of the normal range when the inspecting current is out of the reference range.

In embodiments, a data signal that is applied to the data line in the inspection period may have a positive voltage level.

In embodiments, the initialization voltage may have a negative voltage level in the inspection period.

In embodiments, the first power voltage may have a positive voltage level in the inspection period.

In embodiments, the first through fourth transistors may be p-channel metal-oxide-semiconductor (PMOS) transistors, and the turn-on voltage level may be a negative voltage level.

In embodiments, the first through fourth transistors may be n-channel metal-oxide-semiconductor (NMOS) transistors, and the turn-on voltage level may be a positive voltage level.

In embodiments, the pixel may further include a fifth transistor including a gate terminal configured to receive an emission control signal, a first terminal configured to receive the first power voltage, and a second terminal connected to the first node, a sixth transistor including a gate terminal configured to receive the emission control signal, a first terminal connected to the third node, and a second terminal connected to a fourth node, and an organic light-emitting diode including an anode connected to the fourth node and a cathode configured to receive a second power voltage.

In embodiments, the second power voltage may have a ground voltage level in the inspection period.

In embodiments, the method may further include turning off the fifth and sixth transistors by maintaining the emission control signal to have a turn-off voltage level in the inspection period.

In embodiments, the fifth and sixth transistors may be PMOS transistors, and the turn-off voltage level may be a positive voltage level.

In embodiments, the fifth and sixth transistors may be NMOS transistors, and the turn-off voltage level may be a negative voltage level.

In embodiments, the inspecting current may not flow in a path corresponding to the fifth transistor, the second transistor, the sixth transistor, and the organic light-emitting diode in the inspection period.

In embodiments, the pixel may further include a seventh transistor including a gate terminal configured to receive the scan signal, a first terminal configured to receive the initialization voltage, and a second terminal connected to the fourth node.

In embodiments, the inspecting current may not flow in a path corresponding to the seventh transistor and the organic light-emitting diode in the inspection period.

According to an embodiment, a method of detecting a pixel defect for detecting a defect of a pixel that is connected to a first power voltage source, a second power voltage source, an initialization voltage source, a scan line, an initialization control signal line, and a data line may include turning on a plurality of transistors that are connected in series between the initialization voltage source and the data line in an inspection period, detecting an inspecting current flowing in a path corresponding to the plurality of transistors using a current detector that is connected to the data line, determining that the pixel is a normal pixel when the inspecting current is within a reference range, and determining that the pixel is a defective pixel when the inspecting current is out of the reference range.

In embodiments, the plurality of transistors may include a driving transistor of the pixel.

In embodiments, a data signal that is applied to the data line in the inspection period may have a positive voltage level.

In embodiments, an initialization voltage provided by the initialization voltage source in the inspection period has a negative voltage level.

In embodiments, a first power voltage provided by the first power voltage source in the inspection period may have a positive voltage level.

In embodiments, a second power voltage provided by the second power voltage source in the inspection period may have a ground voltage level.

According to an embodiment, a pixel may include a first transistor including a gate terminal configured to receive a scan signal, a first terminal connected to a data line, and a second terminal connected to a first node, a second transistor including a gate terminal connected to a second node, a first terminal connected to the first node, and a second terminal connected to a third node, a third transistor including a gate terminal configured to receive the scan signal, a first terminal connected to the third node, and a second terminal connected to the second node, a fourth transistor including a gate terminal configured to receive an initialization control signal, a first terminal connected to the second node, and a second terminal configured to receive an initialization voltage, and a storage capacitor including a first terminal configured to receive a first power voltage and a second terminal connected to the second node, The first through fourth transistors may be turned on in an inspection period to form a path through which an inspecting current flows. The pixel may be determined as a normal or defective pixel based on the inspecting current.

BRIEF DESCRIPTION OF THE DRAWINGS

The above and other features will be more clearly understood by describing in detail embodiments thereof with reference to the accompanying drawings.

DETAILED DESCRIPTION OF THE EMBODIMENTS

Figure 1:
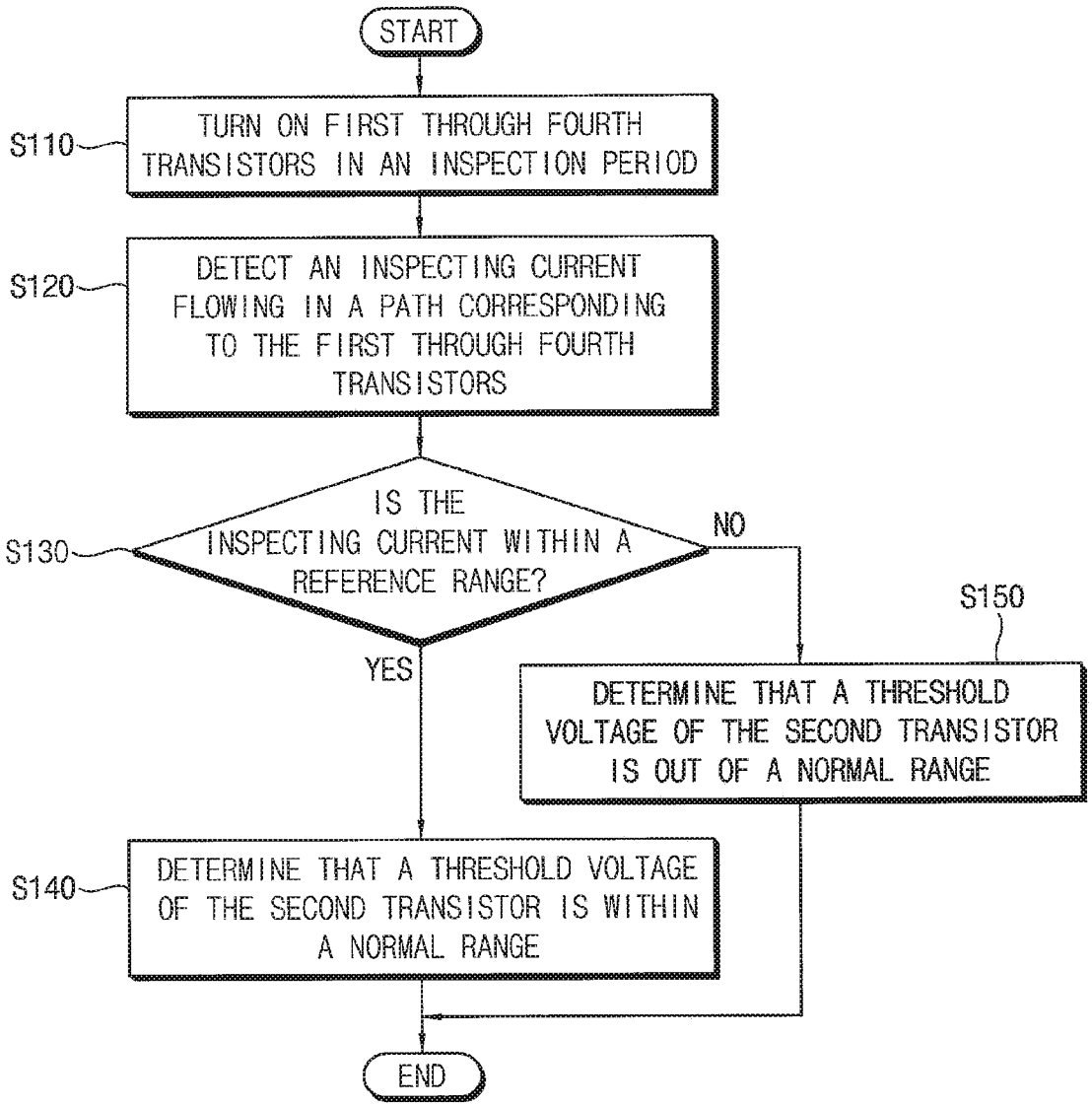
FIG. 1 is a flowchart illustrating a method of detecting a pixel defect according to an embodiment.

Embodiments provide a method of detecting a pixel defect that can accurately detect whether a threshold voltage of a driving transistor of a pixel is out of a normal range (e.g., whether the pixel is a defective pixel).

Hereinafter, embodiments will be explained in detail with reference to the accompanying drawings. Like reference numerals may refer to like elements throughout this application.

Figure 2:
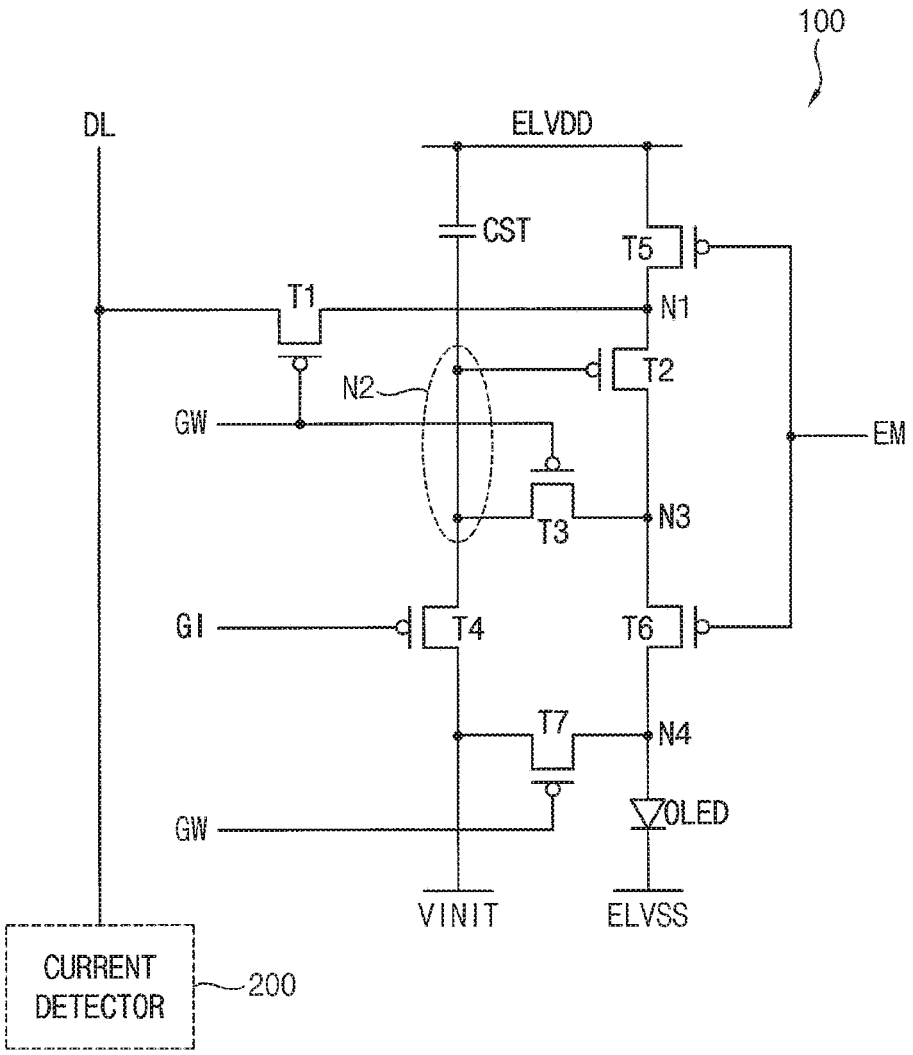
FIG. 2 is a circuit diagram illustrating a pixel of which a defect is detected by the method of FIG. 1 according to an embodiment.
Figure 3:
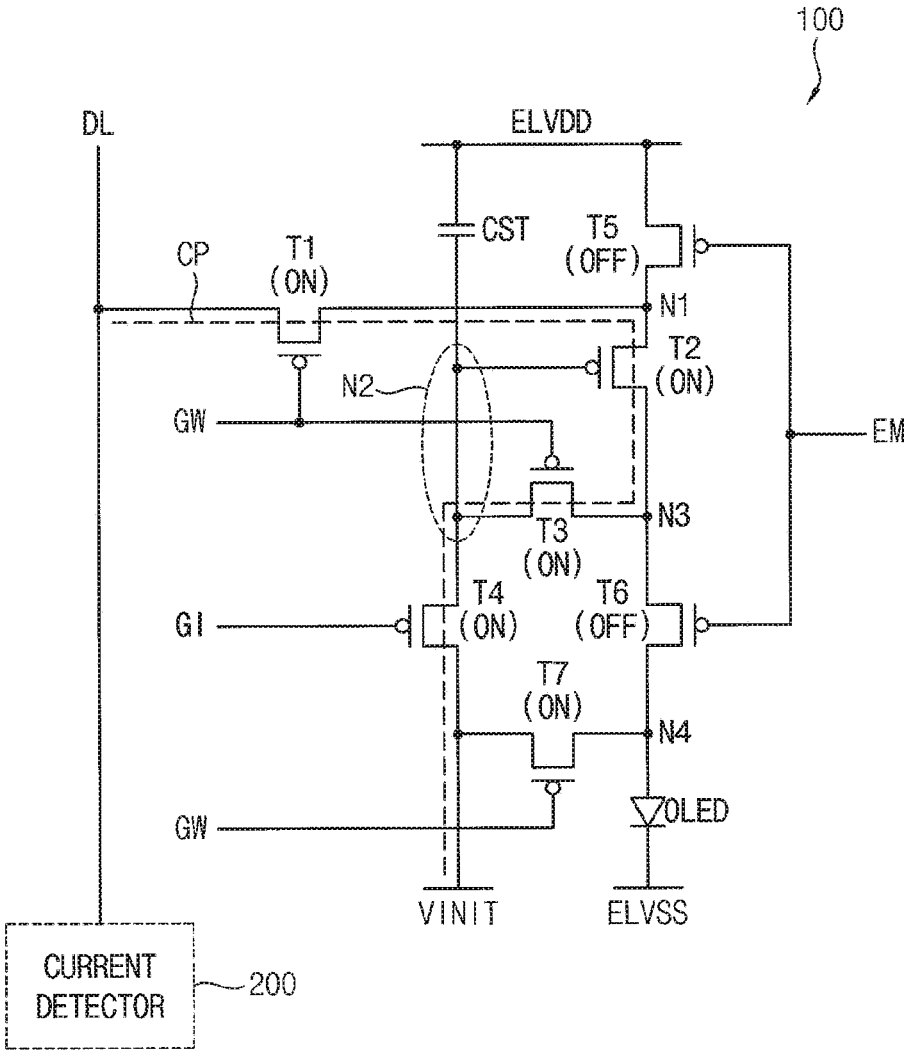
FIGS. 3 and 4 are diagrams illustrating an example in which a path corresponding to first through fourth transistors of the pixel of FIG. 2 is formed by the method of FIG. 1 according to an embodiment.
Figure 4:
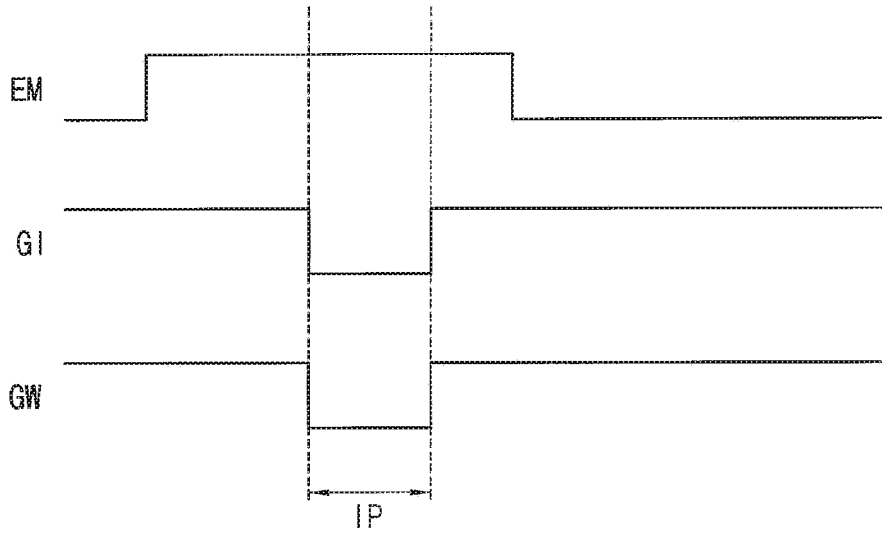

FIG. 1 is a flowchart illustrating a method of detecting a pixel defect according to an embodiment. FIG. 2 is a circuit diagram illustrating a pixel of which a defect is detected by the method of FIG. 1 according to an embodiment. FIGS. 3 and 4 are diagrams illustrating an example in which a path corresponding to first through fourth transistors of the pixel of FIG. 2 is formed by the method of FIG. 1 according to an embodiment.

Referring to FIGS. 1 to 4, the method of FIG. 1 may turn on first through fourth transistors T1 through T4 by changing a scan signal GW and an initialization control signal GI to have a turn-on voltage level in an inspection period IP of a pixel 100 (S110), may detect an inspecting current flowing in a path CP corresponding to the first through fourth transistors T1 through T4 using a current detector 200 that is connected to a data line DL (S120), may check whether the inspecting current is within a reference range (S130), may determine that a threshold voltage of the second transistor T2 (e.g., a driving transistor) is within a normal range (S140) when the inspecting current is within the reference range (S130: YES), and may determine that the threshold voltage of the second transistor T2 is out of the normal range (S150) when the inspecting current is out of the reference range (S130: NO). According to an embodiment, the current detector 200 may be a circuit.

Generally, an organic light-emitting display device may include a plurality of pixels 100 which are minimum light-emitting units and may display an image based on lights emitted by the pixels 100. In an embodiment, as illustrated in FIG. 2, the pixel 100 may include the first through fourth transistors T1 through T4 as well as a storage capacitor CST, fifth through seventh transistors T5 through T7, and an organic light-emitting diode OLED. The first transistor T1 includes a gate terminal that receives the scan signal GW, a first terminal that is connected to the data line DL, and a second terminal that is connected to a first node N1. The second transistor T2 includes a gate terminal that is connected to a second node N2, a first terminal that is connected to the first node N1, and a second terminal that is connected to a third node N3. The third transistor T3 includes a gate terminal that receives the scan signal GW, a first terminal that is connected to the third node N3, and a second terminal that is connected to the second node N2. The fourth transistor T4 includes a gate terminal that receives the initialization control signal GI, a first terminal that is connected to the second node N2, and a second terminal that receives an initialization voltage VINIT. The storage capacitor CST includes a first terminal that receives a first power voltage ELVDD and a second terminal that is connected to the second node N2. The fifth transistor T5 includes a gate terminal that receives an emission control signal EM, a first terminal that receives the first power voltage ELVDD, and a second terminal that is connected to the first node N1. The sixth transistor T6 includes a gate terminal that receives the emission control signal EM, a first terminal that is connected to the third node N3, and a second terminal that is connected to a fourth node N4. The seventh transistor T7 includes a gate terminal that receives the scan signal GW, a first terminal that receives the initialization voltage VINIT, and a second terminal that is connected to the fourth node N4. The organic light-emitting diode OLED includes an anode that is connected to the fourth node N4 and a cathode that receives a second power voltage ELVSS. Since the above structure of the pixel 100 is only an example, the pixel 100 may not include one or more of the transistors T1 through T7 or may further include other components (e.g., a transistor, a capacitor, etc).

The first transistor T1 may provide a data signal that is applied via the data line DL to the first node N1 in response to the scan signal GW (or referred to as a gate signal) that is applied via a scan line. The first transistor T1 may be connected between the data line DL and the first node N1. The first transistor T1 may receive the scan signal GW at the gate terminal of the first transistor T1. For example, the first transistor T1 may be referred to as a switching transistor.

The second transistor T2 may provide a driving current corresponding to the data signal to the organic light-emitting diode OLED. The second transistor T2 may be connected between the first node N1 and the third node N3. The gate terminal of the second transistor T2 may be connected to the second node N2. For example, the second transistor T2 may be referred to as a driving transistor.

The third transistor T3 may connect the second node N2 with the third node N3 (e.g., the second terminal and the gate terminal of the second transistor T2) in response to the scan signal GW of the third transistor T3. The third transistor T3 may be connected between the second node N2 and the third node N3. The third transistor T3 may receive the scan signal GW at the gate terminal of the third transistor T3. The third transistor T3 may be used to compensate for a threshold voltage of the second transistor T2. In other words, as the third transistor T3 is turned on, the second transistor T2 may be diode-connected, and thus a threshold voltage compensating operation for the second transistor T2 may be performed.

The fourth transistor T4 may provide the initialization voltage VINIT to the second node N2 (e.g., the gate terminal of the second transistor T2) in response to the initialization control signal GI that is applied via an initialization control signal line. The fourth transistor T4 may be connected between an initialization voltage source that provides the initialization voltage VINIT and the second node N2. The fourth transistor T4 may receive the initialization control signal GI at the gate terminal of the fourth transistor T4. The fourth transistor T4 may be used to initialize the gate terminal of the second transistor T2 with the initialization voltage VINIT.

The fifth transistor T5 may provide the first power voltage ELVDD to the first node N1 in response to an emission control signal EM. The fifth transistor T5 may be connected between a first power voltage source that provides the first power voltage ELVDD and the first node N1. The fifth transistor T5 may receive the emission control signal EM at the gate terminal of the fifth transistor T5.

The sixth transistor T6 may electrically connect the second transistor T2 with the anode of the organic light-emitting diode OLED in response to the emission control signal EM. The sixth transistor T6 may be connected between the third node N3 and the fourth node N4. The sixth transistor T6 may receive the emission control signal EM at the gate terminal of the sixth transistor T6.

The seventh transistor T7 may provide the initialization voltage VINIT to the fourth node N4 (e.g., the anode of the organic light-emitting diode OLED) in response to the scan signal GW. The seventh transistor T7 may be connected between the initialization voltage source that provides the initialization voltage VINIT and the fourth node N4. The seventh transistor T7 may receive the scan signal GW at the gate terminal of the seventh transistor T7. The seventh transistor T7 may be used to initialize the anode of the organic light-emitting diode OLED with the initialization voltage VINIT.

The storage capacitor CST may be connected between the first power voltage source that provides the first power voltage ELVDD and the second node N2.

The organic light-emitting diode OLED may be connected between the fourth node N4 and a second power voltage source that provides the second power voltage ELVSS. In embodiments, the second power voltage ELVSS may be lower than the first power voltage ELVDD.

As for an operation of the pixel 100 illustrated in FIG. 2, the operation of the pixel 100 may include a non-emission period in which the emission control signal EM has a turn-off voltage level and an emission period in which the emission control signal EM has a turn-on voltage level. Thus, the pixel 100 may operate in the non-emission period and in the emission period.

In an embodiment, the non-emission period may include a first period in which a voltage of the second node N2 is initialized, and a second period in which the data signal (or a data voltage) is written, the threshold voltage of the second transistor T2 is compensated for, and a voltage of the fourth node N4 is initialized. The second period may be after the first period.

In the first period of the non-emission period, the initialization control signal GI may have a turn-on voltage level, and the scan signal GW may have a turn-off voltage level. Thus, the fourth transistor T4 may be turned on, and a voltage of the second node N2 may be initialized with the initialization voltage VINIT. Here, the emission control signal EM may be maintained to have a turn-off voltage level.

In the second period of the non-emission period, the initialization control signal GI may have a turn-off voltage level, and the scan signal GW may have a turn-on voltage level. Thus, the first, third, and seventh transistors T1, T3, and T7 may be turned on, and the fourth transistor T4 may be turned off. As a result, the data signal may be applied to the first node N1, the second transistor T2 may be diode-connected, and the threshold voltage compensating operation for the second transistor T2 may be performed. In addition, when the threshold voltage compensating operation is performed, a voltage of the fourth node N4 may be initialized with the initialization voltage VINIT. Here, the emission control signal EM may be maintained to have a turn-off voltage level.

In the emission period, the initialization control signal GI and the scan signal GW may have a turn-off voltage level, and the emission control signal EM may have a turn-on voltage level. Thus, the fifth and sixth transistors T5 and T6 may be turned on, and the organic light-emitting diode OLED may emit light with luminance corresponding to the data signal. In embodiments, a structure and/or operation of the pixel 100 may be variously designed.

The method of FIG. 1 may be performed in a manufacturing process of the organic light-emitting display device before a shipment of the organic light-emitting display device. In other words, the method of FIG. 1 may prevent a defective product (e.g., a defective organic light-emitting display device) from being provided to consumers by detecting a defect of the pixel 100 included in the organic light-emitting display device in the manufacturing process of the organic light-emitting display device (e.g., by detecting whether the pixel 100, in which the threshold voltage of the second transistor T2 is out of the normal range, exists in the organic light-emitting display device).

For example, the method of FIG. 1 may turn on the first through fourth transistors T1 through T4 (e.g., indicated by ON in FIG. 3) by changing the scan signal GW and the initialization control signal GI to have a turn-on voltage level in the inspection period IP of the pixel 100 (S110). Thus, in the inspection period IP of the pixel 100, the inspecting current may flow in the path CP shown in FIG. 3 corresponding to the first through fourth transistors T1 through T4 in the pixel 100. In an embodiment, as illustrated in FIG. 2, the first through fourth transistors T1 through T4 may be PMOS transistors. In this case, as illustrated in FIG. 4, a turn-on voltage level of the scan signal GW may be a negative voltage level (or a logic low level), and a turn-on voltage level of the initialization control signal GI may be a negative voltage level.

In an embodiment, the first through fourth transistors T1 through T4 may be NMOS transistors. In this case, a turn-on voltage level of the scan signal GW may be a positive voltage level (or a logic high level), and a turn-on voltage level of the initialization control signal GI may be a positive voltage level.

The method of FIG. 1 may turn off the fifth and sixth transistors T5 and T6 (e.g., indicated by OFF in FIG. 3) by maintaining the emission control signal EM to have a turn-off voltage level in the inspection period IP of the pixel 100. Thus, in the inspection period IP of the pixel 100, the inspecting current may not flow in the path corresponding to the fifth transistor T5, the second transistor T2, the sixth transistor T6, and the organic light-emitting diode OLED in the pixel 100.

In an embodiment, as illustrated in FIG. 2, the fifth and sixth transistors T5 and T6 may be PMOS transistors. In this case, as illustrated in FIG. 4, a turn-off voltage level of the emission control signal EM may be a positive voltage level (or a logic high level). In an embodiment, the fifth and sixth transistors T5 and T6 may be NMOS transistors. In this case, a turn-off voltage level of the emission control signal EM may be a negative voltage level (or a logic low level).

In an embodiment, the method of FIG. 1 may control the data signal that is applied to the data line DL to have a positive voltage level (e.g., +5V) in the inspection period IP of the pixel 100, may control the initialization voltage VINIT that is provided from the initialization voltage source to have a negative voltage level (e.g., −5V), may control the first power voltage ELVDD that is provided from the first power voltage source to have a positive voltage level, and may control the second power voltage ELVSS that is provided from the second power voltage source to have a ground voltage level.

As described above, the seventh transistor T7 may be turned on in the inspection period IP of the pixel 100 because the seventh transistor T7 includes the gate terminal that receives the scan signal GW, the first terminal that receives the initialization voltage VINIT, and the second terminal that is connected to the fourth node N4, and because the scan signal GW has a turn-on voltage level in the inspection period IP of the pixel 100. However, because the initialization voltage VINIT that is provided from the initialization voltage source has a negative voltage level and the second power voltage ELVSS that is provided from the second power voltage source has a ground voltage level in the inspection period IP of the pixel 100, a voltage of the cathode of the organic light-emitting diode OLED (e.g., a ground voltage level) may be higher than a voltage of the anode of the organic light-emitting diode OLED (e.g., a negative voltage level), and thus a current (e.g., the inspecting current) may not flow into the organic light-emitting diode OLED.

As a result, as illustrated in FIG. 3, the method of FIG. 1 may allow the inspecting current to flow in the path CP corresponding to the first through fourth transistors T1 through T4 in the inspection period IP of the pixel 100. In embodiments, the method of FIG. 1 may turn on the first through fourth transistors T1 through T4 by changing the scan signal GW and the initialization control signal GI to have a turn-on voltage level. Thus, the method of FIG. 1 may prevent the threshold voltage compensating operation for the second transistor T2, which may be performed when the initialization control signal GI is changed to a turn-on voltage level before the scan signal GW (e.g., an error may occur in the inspecting current if the threshold voltage compensating operation for the second transistor T2 is performed).

Next, the method of FIG. 1 may detect the inspecting current flowing in the path CP corresponding to the first through fourth transistors T1 through T4 using the current detector 200 that is connected to the data line DL (S120). In an embodiment, when first through (n)th data lines DL, where n is an integer greater than or equal to 2, are connected to a display panel of an organic light-emitting display device, first through (n)th current detectors 200 may be connected to the first through (n)th data lines DL, respectively. In this case, the method of FIG. 1 may substantially simultaneously detect defects of pixels 100 included in one pixel-row using the first through (n)th current detectors 200 because the method of FIG. 1 detects a pixel defect (e.g., whether a defective pixel in which the threshold voltage of the second transistor T2 is out of the normal range exists) in units of pixel-rows.

When the pixel 100 performs a display operation, the driving current of the second transistor T2 may be determined by a voltage difference between the gate terminal and a source terminal (e.g., the first terminal) of the second transistor T2 (e.g., the driving transistor), where the voltage difference is formed by the data signal for performing the display operation. On the other hand, when the defect of the pixel 100 is detected, the initialization voltage VINIT (e.g., −5V) may be applied to the second node N2 (e.g., the gate terminal of the second transistor T2) via the fourth transistor T4, and the data signal (e.g., +5V) for detecting the defect of the pixel 100 may be applied to the first node N1 (e.g., the source terminal of the second transistor T2) via the first transistor T1.

Thus, the inspecting current of the second transistor T2 (e.g., tens of μA) that is determined by the voltage difference between the gate terminal and the source terminal of the second transistor T2 when the defect of the pixel 100 is detected may be greater than the driving current of the second transistor T2 (e.g., a few nA) that is determined by the voltage difference between the gate terminal and the source terminal of the second transistor T2 when the pixel 100 performs the display operation. As a result, the method of FIG. 1 may achieve an improved detection-accuracy by detecting the threshold voltage of the second transistor T2 using the inspecting current of the second transistor T2 that is higher than the driving current of the second transistor T2.

Then, the method of FIG. 1 may check whether the inspecting current flowing in the path CP corresponding to the first through fourth transistors T1 through T4 is within the reference range (S130). Here, when the inspecting current is within the reference range, the method of FIG. 1 may determine that the threshold voltage of the second transistor T2 is within the normal range (S140). In other words, when the inspecting current is within the reference range, the method of FIG. 1 may determine that the pixel 100 is the normal pixel. On the other hand, when the inspecting current is out of the reference range, the method of FIG. 1 may determine that the threshold voltage of the second transistor T2 is out of the normal range (S150). In other words, when the inspecting current is out of the reference range, the method of FIG. 1 may determine that the pixel 100 is a defective pixel.

In brief, the method of FIG. 1 may detect a defect of the pixel 100 that is connected to the first power voltage source, the second power voltage source, the initialization voltage source, the scan line, the initialization control signal line, and the data line. Here, the method of FIG. 1 may accurately detect whether the threshold voltage of the driving transistor T2 of the pixel 100 is out of the normal range (e.g., whether the pixel 100 is a defective pixel) by turning on the first through fourth transistors T1 through T4 that are connected in series between the initialization voltage source and the data line DL in the inspection period IP of the pixel 100, by detecting the inspecting current flowing in the path CP corresponding to the first through fourth transistors T1 through T4 using the current detector 200 that is connected to the data line DL, by determining that the pixel 100 is a normal pixel (e.g., determining that the threshold voltage of the driving transistor T2 of the pixel 100 is within the normal range) when the inspecting current is within the reference range, and by determining that the pixel 100 is a defective pixel (e.g., determining that the threshold voltage of the driving transistor T2 of the pixel 100 is out of the normal range) when the inspecting current is out of the reference range.

Figure 5:
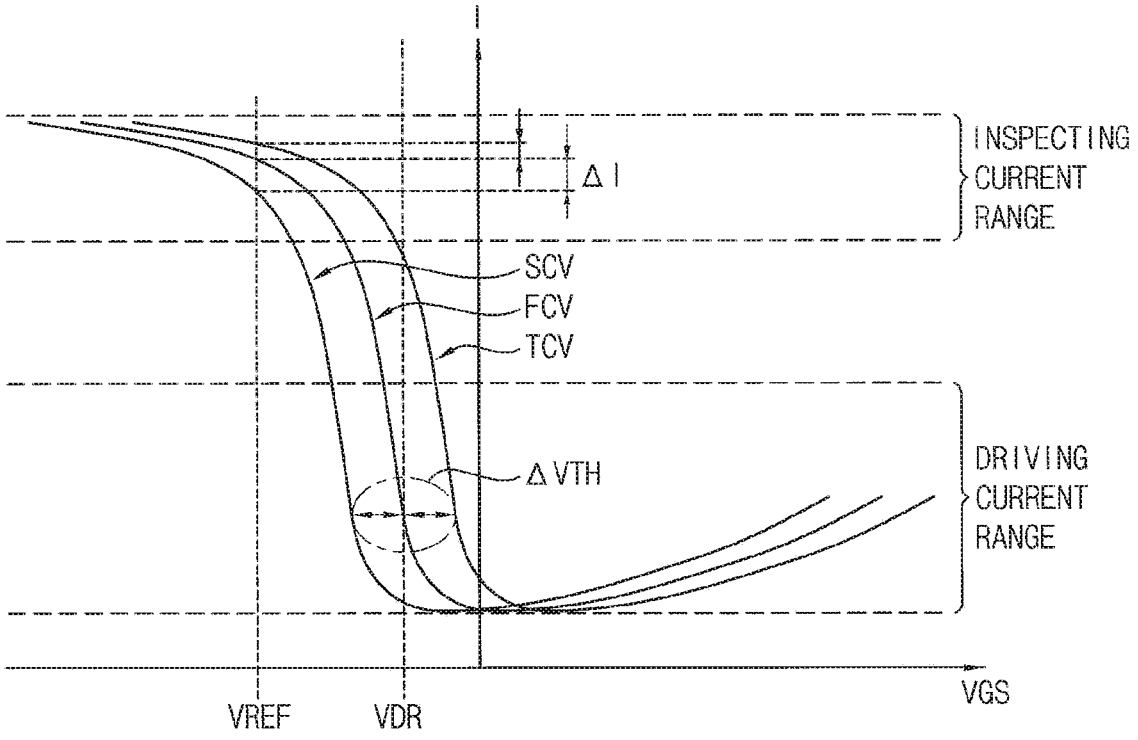
FIG. 5 is a diagram for illustrating that an accuracy of detecting a pixel defect is improved by the method of FIG. 1 according to an embodiment.

FIG. 5 is a diagram for illustrating that an accuracy of detecting a pixel defect is improved by the method of FIG. 1 according to an embodiment.

Referring to FIG. 5, a deviation ΔVTH among threshold voltages VTH of the second transistors T2 (e.g., the driving transistors) of the pixels 100 included in the organic light-emitting display device may exist due to a process deviation in a manufacturing process of the organic light-emitting display device. Generally, a current I flowing through the second transistor T2 may be determined by a voltage difference VGS between the gate terminal and the source terminal of the second transistor T2. As illustrated in FIG. 5, even when the voltage difference VGS between the gate terminal and the source terminal of the second transistor T2 is the same, the current I flowing through the second transistor T2 may differ according to respective characteristic curves of the pixels 100.

In other words, according to whether the pixel 100 is a normal pixel or a defective pixel, the current I flowing through the second transistor T2 may differ even when the voltage difference VGS between the gate terminal and the source terminal of the second transistor T2 is the same. For example, the pixel 100 may have a first characteristic curve FCV when the pixel 100 is an ideal normal pixel, the pixel 100 may have a characteristic curve between a second characteristic curve SCV and a third characteristic curve TCV when the pixel 100 is a tolerable normal pixel, and the pixel 100 may have a characteristic curve that is off to the left of the second characteristic curve SCV or a characteristic curve that is off to the right of the third characteristic curve TCV when the pixel 100 is a defective pixel. Thus, the method of FIG. 1 may determine which characteristic curve the pixel 100 has by detecting the current I flowing through the second transistor T2 of the pixel 100, and may determine whether the pixel 100 is a normal pixel or a defective pixel.

The driving current flowing through the second transistor T2 when the pixel 100 performs the display operation cannot provide sufficient detecting resolution because the driving current flowing through the second transistor T2 when the pixel 100 performs the display operation is relatively small. Thus, in detecting the threshold voltage of the second transistor T2 of the pixel 100, the method of FIG. 1 may not use the driving current flowing through the second transistor T2 when the pixel 100 performs the display operation.

For example, when the pixel 100 performs the display operation, the driving current of the second transistor T2 may be determined within a driving current range (e.g., indicated by DRIVING CURRENT RANGE) by a voltage difference (e.g., indicated by VDR) between the gate terminal and the source terminal of the second transistor T2, which is formed by the data signal for performing the display operation.

On the other hand, when a defect of the pixel 100 is detected, the inspecting current of the second transistor T2 may be determined within an inspecting current range (e.g., indicated by INSPECTING CURRENT RANGE) by a voltage difference (e.g., indicated by VREF) between the gate terminal and the source terminal of the second transistor T2, which is formed by applying the initialization voltage VINIT (e.g., −5V) to the second node N2 via the fourth transistor T4 and by applying the data signal (e.g., +5V) for detecting the defect of the pixel 100 to the first node N1 via the first transistor T1.

In other words, since the inspecting current of the second transistor T2 (e.g., tens of μA) which is within the inspecting current range is greater than the driving current of the second transistor T2 (e.g., a few nA) which is within the driving current range, the method of FIG. 1 may achieve an improved detection-accuracy by detecting the threshold voltage of the second transistor T2 using the inspecting current of the second transistor T2. In other words, as compared to a conventional method that detects the threshold voltage of the second transistor T2 using the driving current of the second transistor T2, the method of FIG. 1 may improve a detection-accuracy for detecting the threshold voltage of the second transistor T2 of the pixel 100 by using the inspection current that is greater than the driving current.

As described above, the method of FIG. 1 may check whether the inspecting current flowing in the path CP corresponding to the first through fourth transistors T1 through T4 in the inspection period IP of the pixel 100 is within a reference range ΔI, may determine that the threshold voltage VTH of the second transistor T2 of the pixel 100 is within the normal range when the inspecting current is within the reference range ΔI (e.g., may determine that the pixel 100 is the normal pixel because the pixel 100 has the characteristic curve between the second characteristic curve SCV and the third characteristic curve TCV), and may determine that the threshold voltage VTH of the second transistor T2 of the pixel 100 is out of the normal range when the inspecting current is out of the reference range ΔI (e.g., may determine that the pixel 100 is the defective pixel because the pixel 100 has the characteristic curve that is off to the left of the second characteristic curve SCV or the characteristic curve that is off to the right of the third characteristic curve TCV). In other words, the method of FIG. 1 may accurately detect whether the threshold voltage VTH of the second transistor T2 (e.g., the driving transistor) of the pixel 100 is out of the normal range (e.g., whether the pixel 100 is a defective pixel) by detecting only the inspecting current flowing in the path CP corresponding to the first through fourth transistors T1 through T4 in the inspection period IP of the pixel 100. As a result, the method of FIG. 1 may prevent a defective product (e.g., a defective organic light-emitting display device) including the defective pixel from being provided to consumers.

Figure 6:
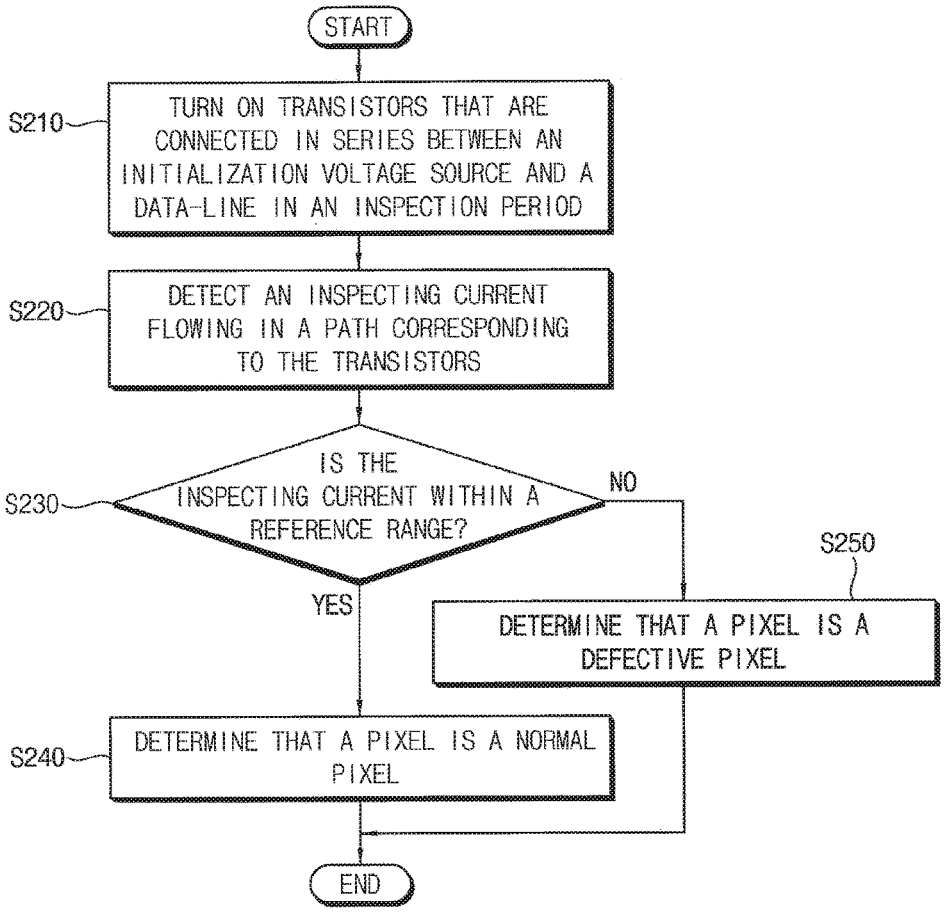
FIG. 6 is a flowchart illustrating a method of detecting a pixel defect according to an embodiment.

FIG. 6 is a flowchart illustrating a method of detecting a pixel defect according to an embodiment.

Referring to FIG. 6, the method of FIG. 6 may detect a defect of a pixel that is connected to a first power voltage source that provides a first power voltage, a second power voltage source that provides a second power voltage, an initialization voltage source that provides an initialization voltage, a scan line that transfers a scan signal, an initialization control signal line that transfers an initialization control signal, and a data line that transfers a data signal. For example, the method of FIG. 6 may turn on a plurality of transistors including a driving transistor that are connected in series between the initialization voltage source and the data line in an inspection period of the pixel (S210), may detect an inspecting current flowing in a path corresponding to the transistors using a current detector that is connected to the data line (S220), may check whether the inspecting current is within a reference range (S230), may determine that the pixel is a normal pixel (e.g., may determine that a threshold voltage of the driving transistor included in the pixel is within a normal range) when the inspecting current is within the reference range (S240), and may determine that the pixel is a defective pixel (e.g., may determine that the threshold voltage of the driving transistor included in the pixel is out of the normal range) when the inspecting current is out of the reference range (S250).

In an embodiment, a data signal applied to the data line in the inspection period of the pixel may have a positive voltage level, the initialization voltage provided by the initialization voltage source in the inspection period may have a negative voltage level, the first power voltage provided by the first power voltage source in the inspection period may have a positive voltage level, and the second power voltage provided by the second power voltage source in the inspection period may have a ground voltage level. As described above, the method of FIG. 6 may accurately detect whether the threshold voltage of the driving transistor of the pixel is out of the normal range (e.g., whether the pixel is a defective pixel) by turning on the transistors that are connected in series between the initialization voltage source and the data line in the inspection period of the pixel, by detecting the inspecting current flowing in the path corresponding to the transistors using the current detector that is connected to the data line, by determining that the pixel is a normal pixel when the inspecting current is within the reference range, and by determining that the pixel is a defective pixel when the inspecting current is out of the reference range. Since these are described above, duplicate descriptions related thereto will not be repeated.

The present inventive concept may be applied to a display device (e.g., an organic light-emitting display device, etc) and an electronic device including the display device. For example, the present inventive concept may be applied to a technical field for detecting a defect of a pixel included in a display device (e.g., for detecting whether a threshold voltage of a driving transistor of the pixel is out of a normal range) in a manufacturing process of the display device before shipment of the display device.

Therefore, as described above, a method of detecting a pixel defect according to embodiments may detect a defect of a pixel that is connected to a first power voltage source, a second power voltage source, an initialization voltage source, a scan line, an initialization control signal line, and a data line. Here, the method may accurately detect whether a threshold voltage of a driving transistor of the pixel is out of a normal range (e.g., whether the pixel is a defective pixel) by turning on a plurality of transistors that are connected in series between the initialization voltage source and the data line in an inspection period. The plurality of transistors may include a first transistor including a gate terminal that receives a scan signal, a first terminal that is connected to the data line, and a second terminal that is connected to a first node, a second transistor including a gate terminal that is connected to a second node, a first terminal that is connected to the first node, and a second terminal that is connected to a third node, a third transistor including a gate terminal that receives the scan signal, a first terminal that is connected to the third node, and a second terminal that is connected to the second node, and a fourth transistor including a gate terminal that receives an initialization control signal, a first terminal that is connected to the second node, and a second terminal that receives an initialization voltage.

The method may detect an inspecting current flowing in a path corresponding to the plurality of transistors using a current detector that is connected to the data line, determine that the pixel is a normal pixel (e.g., by determining that the threshold voltage of the driving transistor of the pixel is within the normal range) when the inspecting current is within a reference range, and determine that the pixel is a defective pixel (e.g., by determining that the threshold voltage of the driving transistor of the pixel is out of the normal range) when the inspecting current is out of the reference range.

While the present inventive concept has been shown and described with reference to embodiments thereof, it will be apparent to those of ordinary skill in the art that various modifications in form and details may be made thereto without departing from the spirit and scope of the present inventive concept as set forth by the appended claims.

What is claimed is:

1. A method of detecting a pixel defect, the method comprising:

turning on transistors of a pixel to form a path, the transistors turned on by changing a scan signal and an initialization control signal to have a turn-on voltage level at a same time in an inspection period;

detecting an inspecting current flowing in the path corresponding to the transistors using a current detector that is connected to a data line;

determining that a threshold voltage of a driving transistor is within a normal range when the inspecting current is within a reference range; and determining that the threshold voltage of the driving transistor is out of the normal range when the inspecting current is out of the reference range.

2. The method of claim 1, wherein a data signal that is applied to the data line in the inspection period has a positive voltage level.

3. The method of claim 1, wherein the initialization voltage has a negative voltage level in the inspection period.

4. The method of claim 1, wherein the pixel includes:

a first transistor including a gate terminal configured to receive a scan signal, a first terminal connected to a data line, and a second terminal connected to a first node, a second transistor including a gate terminal connected to a second node, a first terminal connected to the first node, and a second terminal connected to a third node, a third transistor including a gate terminal configured to receive the scan signal, a first terminal connected to the third node, and a second terminal connected to the second node, a fourth transistor including a gate terminal configured to receive an initialization control signal, a first terminal connected to the second node, and a second terminal configured to receive an initialization voltage, the first to fourth transistors forming the path when the scan signal and the initialization control signal have the turn-on voltage level at the same time in the inspection period, wherein the pixel further includes:

a storage capacitor including a first terminal configured to receive a first power voltage and a second terminal connected to the second node, a fifth transistor including a gate terminal configured to receive an emission control signal, a first terminal configured to receive the first power voltage, and a second terminal connected to the first node, a sixth transistor including a gate terminal configured to receive the emission control signal, a first terminal connected to the third node, and a second terminal connected to a fourth node, and an organic light-emitting diode including an anode connected to the fourth node and a cathode configured to receive a second power voltage.

5. The method of claim 4, wherein the first power voltage has a positive voltage level in the inspection period.

6. The method of claim 4, wherein the first through fourth transistors are p-channel metal-oxide-semiconductor (PMOS) transistors, and the turn-on voltage level is a negative voltage level.

7. The method of claim 4, wherein the first through fourth transistors are n-channel metal-oxide-semiconductor (NMOS) transistors, and the turn-on voltage level is a positive voltage level.

8. The method of claim 4, wherein the second power voltage has a ground voltage level in the inspection period.

9. The method of claim 4, further comprising:

turning off the fifth and sixth transistors by maintaining the emission control signal to have a turn-off voltage level in the inspection period.

10. The method of claim 9, wherein the fifth and sixth transistors are PMOS transistors, and the turn-off voltage level is a positive voltage level.

11. The method of claim 9, wherein the fifth and sixth transistors are NMOS transistors, and the turn-off voltage level is a negative voltage level.

12. The method of claim 9, wherein the inspecting current does not flow in a path corresponding to the fifth transistor, the second transistor, the sixth transistor, and the organic light-emitting diode in the inspection period.

13. The method of claim 4, wherein the pixel further includes a seventh transistor including a gate terminal configured to receive the scan signal, a first terminal configured to receive the initialization voltage, and a second terminal connected to the fourth node.

14. The method of claim 13, wherein the inspecting current does not flow in a path corresponding to the seventh transistor and the organic light-emitting diode in the inspection period.

15. A method of detecting a defect of a pixel that is connected to a first power voltage source, a second power voltage source, an initialization voltage source, a scan line, an initialization control signal line, and a data line, the method comprising:

turning on a plurality of transistors that are connected in series between the initialization voltage source and the data line in an inspection period, one or more of the transistors turned on by a scan signal and one or more others of the transistors turned on by an initialization control signal, the scan signal and the initialization control signal having a turn-on level at a same time to form a path;

detecting an inspecting current flowing in the path corresponding to the plurality of transistors using a current detector that is connected to the data line;

determining that the pixel is a normal pixel when the inspecting current is within a reference range; and determining that the pixel is a defective pixel when the inspecting current is out of the reference range.

16. The method of claim 15, wherein the plurality of transistors include a driving transistor of the pixel.

17. The method of claim 16, wherein a data signal that is applied to the data line in the inspection period has a positive voltage level.

18. The method of claim 16, wherein an initialization voltage provided by the initialization voltage source in the inspection period has a negative voltage level.

19. The method of claim 16, wherein a first power voltage provided by the first power voltage source in the inspection period has a positive voltage level.

20. The method of claim 16, wherein a second power voltage provided by the second power voltage source in the inspection period has a ground voltage level.

21. A pixel comprising:

a first transistor including a gate terminal configured to receive a scan signal, a first terminal connected to a data line, and a second terminal connected to a first node;

a second transistor including a gate terminal connected to a second node, a first terminal connected to the first node, and a second terminal connected to a third node;

a third transistor including a gate terminal configured to receive the scan signal, a first terminal connected to the third node, and a second terminal connected to the second node;

a fourth transistor including a gate terminal configured to receive an initialization control signal, a first terminal connected to the second node, and a second terminal configured to receive an initialization voltage; and a storage capacitor including a first terminal configured to receive a first power voltage and a second terminal connected to the second node, wherein the first through fourth transistors are turned on by the scan signal and the initialization control signal having a turn-on level at a same time in an inspection period to form a path through which an inspecting current flows, and the pixel is determined as a normal or defective pixel based on the inspecting current.

* * * * *